US006254291B1

(12) United States Patent
Sakano

(10) Patent No.: US 6,254,291 B1
(45) **Date of Patent: *Jul. 3, 2001**

(54) DOT-IMPACT PRINTING HEAD CONTROL APPARATUS

(75) Inventor: Katsuji Sakano, Yamagata (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,339

(22) Filed: Feb. 25, 1999

(30) Foreign Application Priority Data

Feb. 27, 1998 (JP) ..... 10-047383

(51) Int. Cl.[7] ..... B41J 2/22

(52) U.S. Cl. ..... 400/124.01; 400/124.02; 400/124.04; 400/124.05; 400/124.11; 400/157.2; 400/157.3

(58) Field of Search ..... 400/124.01, 124.02, 400/124.04, 124.05, 124.11, 124.24, 124.28, 124.29, 157.2, 157.3

(56) References Cited

U.S. PATENT DOCUMENTS

| | | | | |
|---|---|---|---|---|
| 5,030,020 | * | 7/1991 | Kikuchi et al. | 400/124 |
| 5,147,141 | * | 9/1992 | Sakaida et al. | 400/124 |
| 5,167,459 | * | 12/1992 | Yano et al. | 400/124 |
| 5,190,383 | * | 3/1993 | Suzuki et al. | 400/124 |
| 5,302,035 | * | 4/1994 | Ueda | 400/124 |

FOREIGN PATENT DOCUMENTS

| | | |
|---|---|---|
| 60-124264 | 7/1985 | (JP) . |
| 64-22562 | 1/1989 | (JP) . |
| 1-190464 | 7/1989 | (JP) . |
| 02241754 | 9/1990 | (JP) . |
| 04310760 | 11/1992 | (JP) . |
| 0596791 | 4/1993 | (JP) . |
| 05185617 | 7/1993 | (JP) . |
| 05193161 | 8/1993 | (JP) . |
| 0776113 | 3/1995 | (JP) . |
| 07314739 | 12/1995 | (JP) . |
| 8-318633 | 12/1996 | (JP) . |

OTHER PUBLICATIONS

Japanese Office Action issued Oct. 12, 1999 in a related application.
English translation of relevant portions of Oct. 12, 1999 Japanese Office Action.

* cited by examiner

*Primary Examiner*—John S. Hilten
*Assistant Examiner*—Minh Chau
(74) *Attorney, Agent, or Firm*—Ostrolenk, Faber, Gerb & Soffen, LLP

(57) ABSTRACT

A printing head control apparatus 10 is used for a dot-impact printer in which a dot is formed on a paper set on a platen via an ink ribbon 16 with an impact force applied by a pin 18. The printing head control apparatus 10 comprises: a dot classifier for classifying into a normal dot b1 and a final dot b2 the dots constituting a print data "a" supplied from an upper-node apparatus 20; and a printing head drive controller 26 for supplying to the printing head 24 a normal dot print drive signal c1 and a final dot print drive signal c2 for the normal dot b1 and the final dot b2, respectively.

12 Claims, 3 Drawing Sheets

DOT-IMPACT PRINTING HEAD CONTROL APPARATUS

BACKGROUND OF THE INVENTION

1. Field of the Invention

The present invention relates to a printing head control apparatus for used in a dot-impact printer.

2. Description of the Related Art

In a conventional dot-impact printer, a printing head sometimes prints an additional dot at an unnecessary place where no printing is to be performed. The reason of this additional printing is considered to be a rebound caused after completion of a printing. To cope with this, conventionally, a countermeasure has been taken in the printing head configuration.

However, modification of the printing head configuration is accompanied with a significant design modification, increasing the costs and the obtained effect is insufficient.

SUMMARY OF THE INVENTION

It is therefore an object of the present invention to provide a printing head control apparatus capable of preventing an additional printing caused by a rebound operation, without design modification of the printing head.

The dot-impact printing head control apparatus according to the present invention is for use in a dot-impact printer in which a dot is formed by an impact applied with a pin via an ink ribbon onto a paper set on a platen, the apparatus comprising: a dot classifier for classifying into normal dots and final dots the dots constituting a print data supplied from an upper-node apparatus; and a printing head drive controller for supplying a printing head with a normal dot print drive signal and a final dot print drive signal corresponding to the normal dot and the final dot, respectively.

For example, the final dot may be a single dot on the time axis or a final dot of sequential dots. The normal dot is a dot other than the final dot. The final dot print drive signal is set so that the pin presses the paper to the platen longer time than the normal dot print drive signal.

When a print data is supplied from the upper-node apparatus to the dot classifier, dots constituting the print data are classified by the dot classifier into the normal dots and the final dots. The normal dots and the final dots classified by the dot classifier are converted by the print head drive controller into normal dot print drive signals and a final dot print drive signals, respectively. The printing head, in response to the normal dot print drive signal or the final dot print drive signal, applies an impact with a pin via an ink ribbon onto the paper set on the platen.

For example, the final dot print drive signal is set so as to excite the printing head for a longer time than the normal dot print drive signal. This reduces the pin return speed in the final dot printing operation, enabling to reduce the rebound amount and prevent an unnecessary dot generation.

BRIEF DESCRIPTION OF THE DRAWINGS

FIG. 2[1] shows an example of a sequential dot configuration; and FIG. 2[2] shows an example of a single dot configuration.

DESCRIPTION OF THE PREFERRED EMBODIMENTS

Hereinafter, embodiments of the present invention will be detailed with reference to the attached drawings.

Figure 1:
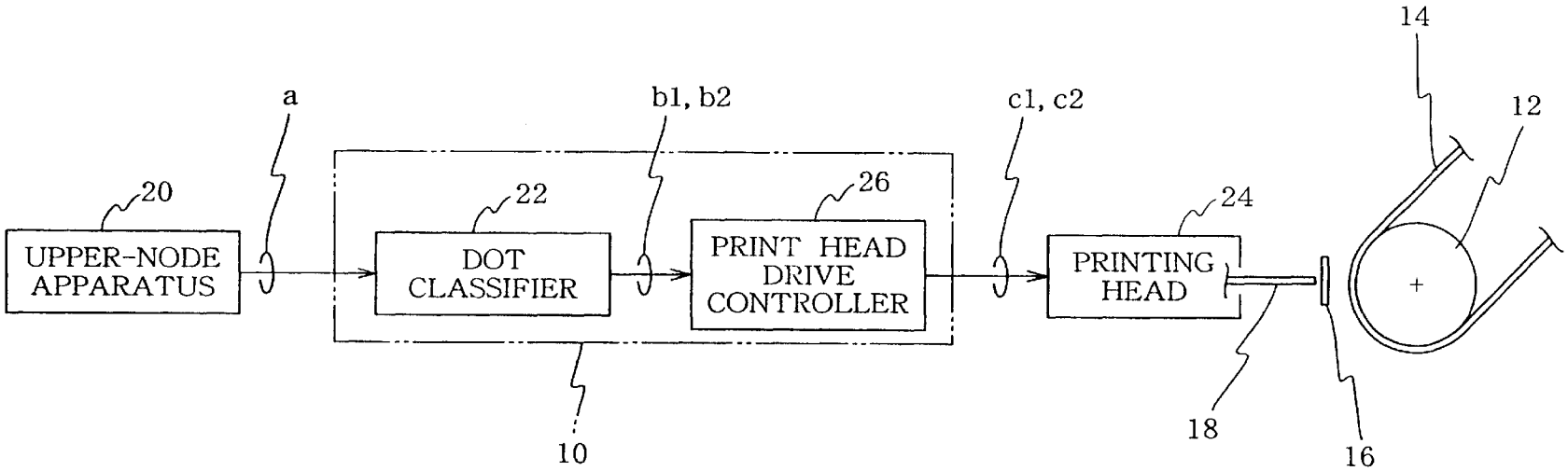
FIG. 1 is a block diagram showing a printing head control apparatus according to an embodiment of the present invention.

FIG. 1 is a block diagram showing a printing head control apparatus according to a first embodiment of the present invention.

The printing head control apparatus 10 is for use in a dot-impact printer for applying a force by a pin 18 via an ink ribbon 16 onto a paper 14 set on a platen 12. The printing head control apparatus 10 comprises a dot classifier 22 for classifying dots of a print data supplied from an upper-node apparatus 20, according to a normal dot b1 and a final dot b2; and a printing head drive controller 26 for supplying to a printing head 24 a normal print drive signal c1 and a final print drive signal c2 for the normal dot b1 and the final dot b2, respectively.

The printing head widely used is an electromagnetic type in which an impact force is obtained by exciting an electromagnetic coil. The printing head control apparatus 10 can be realized, for example, by a microcomputer and a DC power source. The dot classifier classifies various dots constituting the print data a and produces at least two signals (for the normal dot b1 and the final dot b2) to the printing head drive controller 26. That is, the dot classifier 22 monitors the dots for each number of pins 18 of the printing head 24 and produces a corresponding signal to the printing head drive controller 26. The printing head drive controller 26 supplies at least two types of drive current (the normal dot print drive signal c1 and the final dot print drive signal c2) to the printing head 24.

Here, the printing head 24 is assumed to be for a serial dot-impact printer in which about thirty pins 18 are arranged in a longitudinal direction. These pins 18 will be numbered from 1 to 30 such as Pin No. 1 and Pin No. 2. For example, when printing a letter "H" (print data a) constituted by straight lines, each constituted by a series of dots in a longitudinal direction, the horizontal bar portion (pin No. 15) should be printed by a sequential dot configuration. Here, the rightmost dot alone is classified as the final dot b2 and the other dots are classified as the normal bits b1. The vertical bar portions (pin Nos. 1 to 30 excluding pin No. 15) have a single dot configuration and all the bits are classified as the final dots b2.

Figure 2:
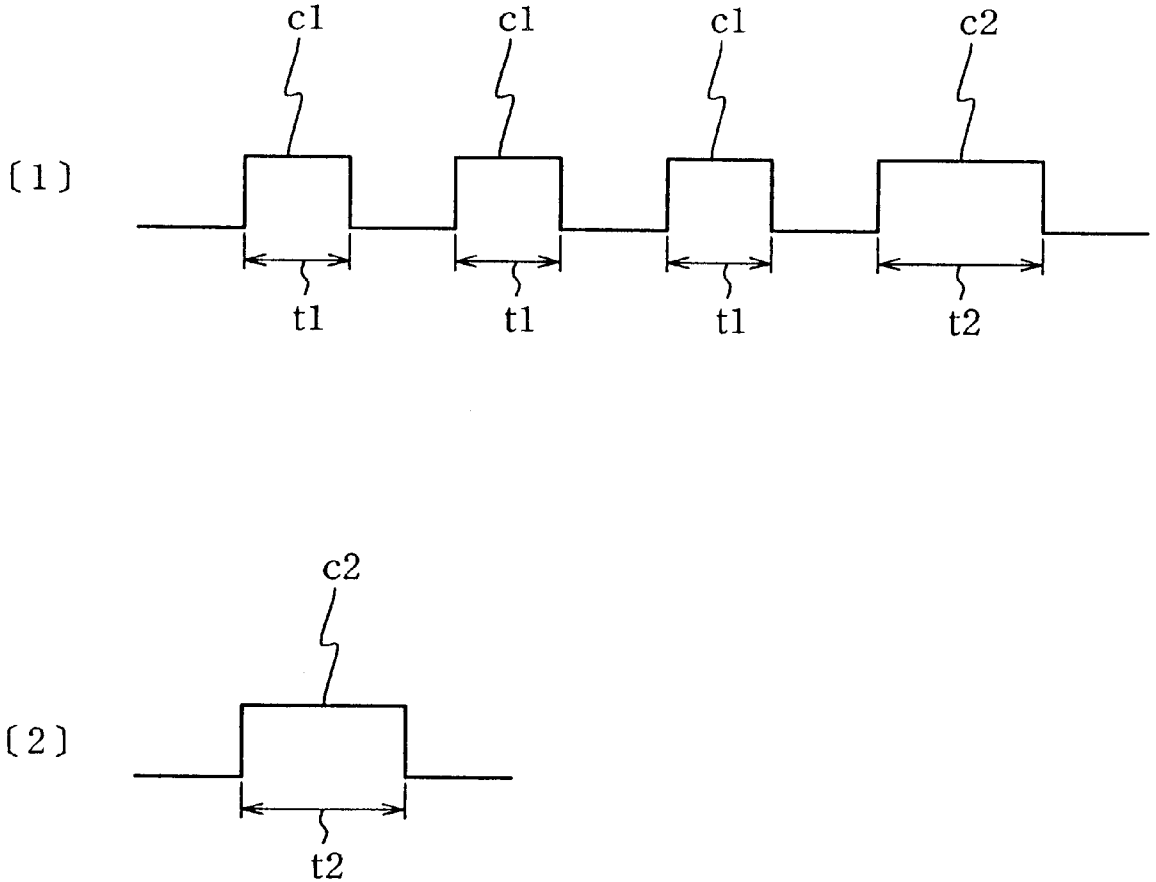
FIG. 2 shows a waveform of a drive current produced from the printing head drive controller in the printing head control apparatus.

FIG. 2 shows a waveform of a drive current produced from the printing head drive controller 26 of FIG. 1. Hereinafter, an explanation will be given with reference to this FIG. 2.

The final dot print drive signal c2 is produced for a final bit of a sequential dot configuration consisting of more than one dot as shown in FIG. 2[1], or for a single bit configuration as shown in FIG. 2[2]. Moreover, the normal dot print drive signal c1 is produced for dots of a sequential dot configuration excluding the final dot. The final dot print drive signal c2 has a pulse width t2 greater than the pulse width t1 of the normal dot print drive signal c1. That is, the final dot print drive signal c2 is set to have a longer excitation time than the normal dot print drive signal c1.

Next, operation of the printing head control apparatus 10 will be detailed with reference to FIG. 1 and FIG. 2.

When a print data "a" is produced from the upper-node apparatus 20, the dots constituting the print data "a" are classified by the dot classifier 22 into the normal dots b1 and the final dots b2. The final dots b2 are either single dots or final dots of sequential dots. The normal bits b1 are bits other than the final dots b2. The normal dots b1 and the final dots b2 classified by the dot classifier 22 are respectively converted by the printing head drive controller 26 into the normal dot print drive signals c1 and the final dot print drive signals c2. According to a normal dot print drive signal c1 or a final dot print drive signal c2, the printing head 24 applies an impact force with the pin 18 via the ink ribbon 16 to the paper 14 placed on the platen 12. The final dot print drive signal b2 is set so as to maintain the pin 18 pressing the paper 14 on the platen 12 for a longer time than the normal dot print drive signal c1.

Figure 3:
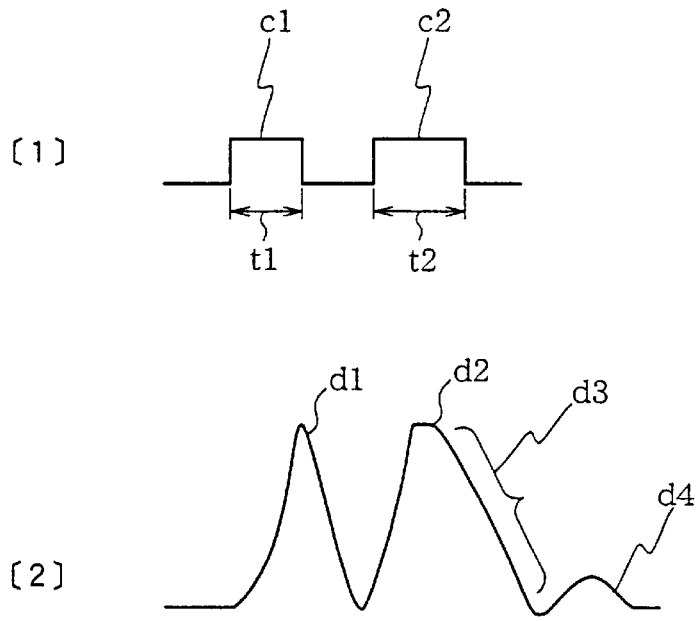
FIG. 3 shows a relationship between a drive current produced from the printing head drive controller (FIG. 3[1]) and a printing head pin operation (FIG. 3[2]).

FIG. 3 shows a waveform of a drive current from the printing head drive controller 26 in relation to the operation of the pin 18 of the printing head 24. FIG. 3[1] shows a drive current, and FIG. 3[2] shows the pin operation.

The final dot print drive signal c2 is set to have a longer excitation time by 100 microseconds for example, than the normal dot print drive signal c1. The final dot print drive signal c2 causes a final dot printing operation d2 having a lower operation speed than the normal dot print operation d1. Especially, the return speed d3 is lowered. This results in that the reduction of the operation energy of the rebound operation d4. Thus, the rebound operation d4 is lowered. This can suppress generation of an additional dot.

Figure 4:
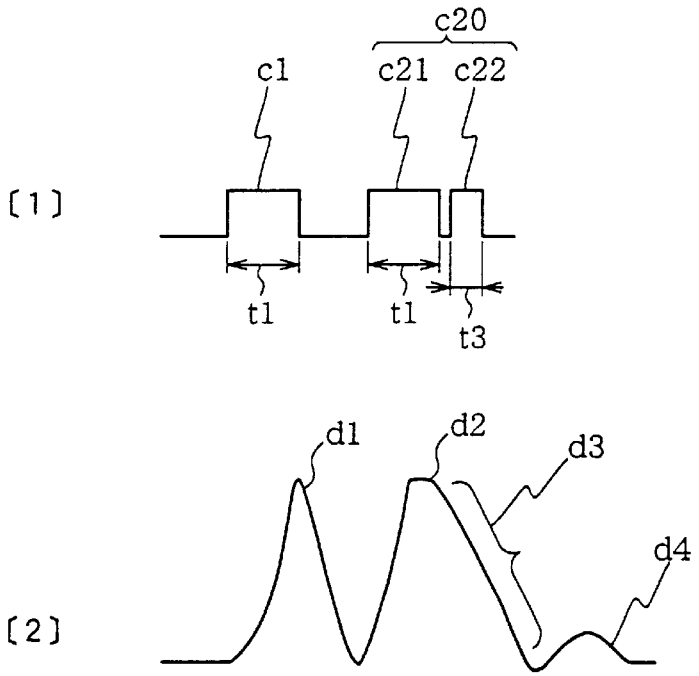
FIG. 4 shows a printing head control apparatus according to a second embodiment of the present invention, as a relationship between a drive current produced from a printing head drive controller (FIG. 4[1]) and a printing head pin operation (FIG. 4[2]).

FIG. 4 shows a waveform obtained by a printing head control apparatus according to a second embodiment of the present invention. FIG. 4[1] shows a drive current produced form the printing head drive controller, and FIG. 4[2] shows the printing head pin operation. Hereinafter, an explanation will be given with reference to this FIG. 4. Like components are denoted by like reference symbols.

In the second embodiment, the final dot print drive signal c20 is constituted by a drive signal c21 and a drive signal c22. The drive signal c21 is identical to the normal dot print drive signal b1, and the drive signal c22 has a pulse width t3 which is half of the pulse width t1 of the normal dot print drive signal c1. The drive signal c22 is produced in 20 microseconds after completion of the drive signal c21. In this case, the final dot print drive signal c20 is substantially identical to the final dot print drive signal c2 in the first embodiment. Consequently, in this second embodiment, it is possible to obtain the same function and effect as in the first embodiment.

As has thus far been described, in the printing head control apparatus according to the present invention, the print data is classified into normal dots and final dots, so that normal dot print drive signals and final dot print drive signals are produced correspondingly to the printing head. Accordingly, it is possible to prevent generation of an additional dot after the final dot printing operation, without adding any mechanical element to the printing head.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 10-047383 (Filed on Feb. 27$^{th}$, 1998) including specification, claims, drawings and summary are incorporated herein by reference in its entirety.

What is claimed is:

1. A control circuit for a dot impact printing head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing surface when said final dot is printed, wherein said final dot excitation signal is longer than said regular dot excitation signal.

2. A control circuit for a dot impact printing head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing surface when said final dot is printed, wherein said final dot excitation signal causes said pin to press upon said printing surface for a longer period of time than when said regular dot excitation signal causes said pin to press upon said printing surface.

3. A control circuit for a dot impact printing head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing surface when said final dot is printed, wherein said final dot excitation signal has a longer pulse width than said regular dot excitation signal.

4. A combination of a dot impact printing head and a control circuit for controlling the operation of said print head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing surface when said final dot is printed, wherein said final dot excitation signal is longer than said regular dot excitation signal.

5. A combination of a dot impact printing head and a control circuit for controlling the operation of said print head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing when said final dot is printed, wherein said final dot excitation signal causes said pin to press upon said printing surface for a longer period of time than when said regular dot excitation signal causes said pin to press upon said printing surface.

6. A combination of a dot impact printing head and a control circuit for controlling the operation of said print head, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said control circuit comprising:

a dot classifier which classifies each dot to be formed by said printing pin as either a regular dot forming one of a sequence of dots or a final dot being the last dot in said sequence; and a drive controller which generates regular dot and final dot excitation signals which drive said pin as a function of whether a dot to be formed is a regular dot or a final dot, wherein said final dot excitation signal is designed so as to inhibit a rebound of said pin off of said printing surface when said final dot is printed, wherein said final dot excitation signal has a longer pulse width than said regular dot excitation signal.

7. A method of controlling a printing of a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of:

classifying dots to be formed by said printing pin as either a regular dot forming one of a sequence of dots or a final dot being the last dot in said sequence;

generating a regular dot excitation signal for said regular dots; and generating a final dot excitation signal for said final dots, said final dot excitation signal inhibiting a rebound of said pin off of said printing surface when said final dot is printed, wherein said final dot excitation signal causes said pin to press upon said printing surface for a period of time than when said regular dot excitation signal causes said pin to press upon said printing surface.

8. A method of controlling a printing of a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of:

classifying dots to be formed by said printing pin as either a regular dot forming one of a sequence of dots or a final dot being the last dot in said sequence;

generating a regular dot excitation signal for said regular dots; and generating a final dot excitation signal for said final dots, said final dot excitation signal inhibiting a rebound of said pin off of said printing surface when said final dot is printed, wherein said final dot excitation signal is longer than said regular dot excitation signal.

9. A method of controlling a printing of a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of:

classifying dots to be formed by said printing pin as either a regular dot forming one of a sequence of dots or a final dot being the last dot in said sequence;

generating a regular dot excitation signal for said regular dots; and generating a final dot excitation signal for said final dots, said final dot excitation signal inhibiting a rebound of said pin off of said printing surface when said final dot is printed, wherein said final dot excitation signal has a longer pulse width than said regular dot excitation signal.

10. A method of printing dots by a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of:

classifying dots to be formed by said printing pin as either a regular dot forming one of a sequence of dots or a final dot being the last dot in said sequence;

generating a regular dot excitation signal for said regular dots;

generating a final dot excitation signal for said final dots;

printing said regular dots;

printing one of said final dots;

inhibiting a rebound of said pin off of said printing surface after said second printing, wherein said act of inhibiting comprises the act of causing said pin to press upon said printing surface when performing said act of printing one of said final dots for a longer period of time than when performing said act of printing said regular dot.

11. A method of printing dots by a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of;

classifying dots to be formed by said printing pin as either a regular dot forming one of a sequence of dots or a final dot being the last dot in said sequence;

generating a regular dot excitation signal for said regular dots;

generating a final dot excitation signal for said final dots;

printing said regular dots;

printing one of said final dots;

inhibiting a rebound of said pin off of said printing surface after said second printing, wherein said final dot excitation signal is longer than said regular dot excitation signal.

12. A method of printing dots by a dot impact printing head on a printing surface, said dot impact printing head including a printing pin moveable between a non-impact position and an impact position, at said impact position said pin generates a dot on a printing surface, said printing head being movable with respect to said printing surface, said printing pin further being sequentially actuable to form a sequence of dots on said printing surface, said method comprising the acts of:

classifying dots to be formed by said printing pin as either a regular dot forming one of a sequence of dots or a final dot being the last dot in said sequence;

generating a regular dot excitation signal for said regular dots;

generating a final dot excitation signal for said final dots;

printing said regular dots;

printing one of said final dots;

inhibiting a rebound of said pin off of said printing surface after said second printing, wherein said final dot excitation signal has a longer pulse width than said regular dot excitation signal.

* * * * *